United States Patent [19]

Codatto

[11] Patent Number: 4,905,976

[45] Date of Patent: Mar. 6, 1990

[54] MANIPULATORS FOR PLATE SHEETS

[76] Inventor: Antonio Codatto, Via Alcide de Gasperi 20, Lonigo (Vicenza), Italy

[21] Appl. No.: 221,318

[22] Filed: Jul. 19, 1988

[30] Foreign Application Priority Data

Jul. 23, 1987 [IT] Italy ..... 85580 A/87

[51] Int. Cl.[4] ..... B41L 43/00

[52] U.S. Cl. ..... 270/32; 29/243.5; 414/225

[58] Field of Search ..... 270/32, 45, 58; 428/121; 493/225, 226, 749, 751, 753; 414/222, 225, 226, 753; 29/559, 243.5, 243.58; 269/25, 55, 74, 57

[56] References Cited

U.S. PATENT DOCUMENTS

| | | | |
|---|---|---|---|
| 3,103,354 | 9/1963 | Patterson | 270/58 |
| 4,573,861 | 3/1986 | Aschauer | 414/751 |
| 4,708,573 | 11/1987 | Hug | 414/751 |
| 4,775,281 | 10/1988 | Prentakis | 414/786 |
| 4,808,059 | 2/1989 | Eddy | 414/225 |

*Primary Examiner*—Robert E. Garrett
*Assistant Examiner*—Therese M. Newholm
*Attorney, Agent, or Firm*—Bucknam and Archer

[57] ABSTRACT

The manipulator comprises a support structure 1 with a vice 5 vertically disposed capable of grasping a plate sheet 22 and carrying it to the press 23, the plate sheet performing a rigorously linear course. The support structure is intended to perform a rototranslatory motion, rotating around pivot 11 which is located corresponding to the extremity of the support structure opposite to the extremity in which the vice 5 is placed. This pivot slides along guide 13 which is located laterally with respect to the direction of advance of the plate, the direction of the guide being perpendicular with respect to the direction of advance of the plate. The energy required to transport the plate from the loading zone to the press is reduced to about one-half with respect to the energy required in similar devices of known type in which a support structure which carries the plate sheet from the loading zone to the press performs exactly the same course of the plate (see FIG. 3).

7 Claims, 5 Drawing Sheets

MANIPULATORS FOR PLATE SHEETS

The present invention relates to manipulators for plate sheets.

Manipulators for metallic sheets are known, the sheets being planar, the manipulators being capable of lifting the sheets from a loading zone and carrying the sheets to a folding press which provides to carry out the folding of one or more of the borders of the sheets. These sheets after they have been folded and sealed reciprocally in a suitable manner are used in the automobile field for the production of the bodies of the auto vehicles as well as in the production of electric apparatuses used in a home, such as refrigerators, washing machines, air conditioners, as well as the production of frames for furniture and the like.

In the present state of the art there are known some manipulators which comprise in particular a vice with two jaws opposite one to the other, vertically arranged, capable of grasping a single plate corresponding to the loading zone to carry it to a point corresponding to the press. This vice is capable of rotating around its axis in one direction and in the opposite direction, thus causing the rotation of the plate sheet which then may be subjected to the folding operation corresponding to all its borders.

One of these devices permits the two jaws of the vice to be mounted corresponding to the extremities of a structure having the shape of a C, which is capable of moving only linearly, the vice remaining therefore always turned towards the section of insertion of the plate in the press. The loading of the sheets on the manipulator must necessarily occur in the direction transversal with respect to the direction of travel of the manipulator.

The main drawback of this device consists of the fact that it is not absolutely possible to load one plate on the manipulator prior to the time the manipulator has unloaded the preceding plate and prior to the time the manipulator has completed the return course backwards so as to dispose itself downstream with respect to the loading device. Further, since the manipulator, which is a structure of great mass, performs an advance motion exactly equal to the motion performed by the plate, it is clear that it is necessary to utilize a motor of substantial power, a fact which causes an increase in the cost of the device as well as an increase in the consumption of the energy required for the motion of the device itself.

In another manipulator of known type, the vice is supported by a portal structure which is also provided only with the possibility of linear movement from the loading zone to the press. The main drawback of this structure is that it presents substantial transversal dimensions, in view of the fact that the distance between the two columns must be greater than the major diagonal of the panel of the plate for the purpose of permitting the rotation of the panel. Further, the guides of the portal are under strong stress and have a tendency to be deformed, thus causing in the final analysis a certain lack of accuracy of the folding operation. Further, also in this case it is necessary to move the entire substantial mass of the portal of an amount equal to the displacement imparted to the plate sheet. With respect to the previous device, it is however possible to dispose in the loading zone a new sheet as soon as the portal has left the zone mentioned hereinabove to travel towards the loading zone.

Both these devices are provided with jaws which may be caused to rotate only of an angle of 90° and 180° and this fact excludes for instance the possibility of operating with a panel which does not have the rectangular shape.

An object of the present invention is to provide a manipulator device for sheets which presents advantageous constructive and functional characteristics compared with the characteristics of similar devices of known type.

Another object of the present invention is to provide a manipulator which has a blocking device which holds the vice securely in any position desired by the user. Thus it is possible to permit the rotation of the jaws which grasp the plate along an angle of any extension and in particular several angles different from 90° and 180° as in the case of similar known devices.

According to the present invention the supporting structure of the upper jaw which has the shape of a double T is pivoted corresponding to the side opposite to the side in which the upper jaw itself is located, on a carriage which is capable of travelling along a guide disposed in a perpendicular direction with respect to the direction of travel performed by the plate when the latter reaches the press.

The lower jaw on the other hand is mounted on a vertical shaft. The latter constitutes the pin of connection between the lateral lower extremity of the supporting structure and a longitudinal carriage which is capable of moving along the direction of travel of the plate. After the longitudinal carriage has been caused to advance in a manner to cause the advance of the plate, the transversal trolley moves along its guide and the entire structure performs a "wigwag" motion with the mast still moveable so that the two jaws and therefore the plate move in a perfectly rectilinear manner. Further, there are provided means capable of permitting and causing the rotation of the two vertical jaws around their axis so as to permit the press to operate along all the borders of the plates.

According to a further embodiment of the invention, effective means for blocking the lower jaw are provided, a fact which permits to stop the angular course of this jaw corresponding to each desired angle and not only corresponding to three or four pre-established positions which is the case with the known manipulators. In actual practice around a portion of the shaft to which the jaw is fixed, an annular cylindrical chamber is disposed, the surface of separation of the chamber from the shaft being intended to bend after the chamber has been filled with fluid under pressure, thus exerting such a force on the shaft that the rotation is prevented.

Naturally, there are also provided means capable of determining the rotation of the shaft fixed to the lower jaw, the motion of which obviously is transmitted to the upper jaw.

Advantageously there is provided a device for the automatic control of the angular position of the jaws for the purpose of satisfying the particular requirements of folding of the borders of the plate.

It is clear from the foregoing that the energy required to cause the motion of the moveable elements of the manipulator is substantially less than the energy required to guarantee the motion of the moveable elements in the known manipulators. In fact, the known manipulators are intended to carry out a course exactly equal to the course carried out by the plate from the loading zone to the press, while with the device according to the present invention the motion performed by the center of gravity of the moveable elements is practically one-half of the motion performed by the plate. In addition, with the device according to the present invention, it is possible to dispose a new sheet corresponding to the loading zone immediately after the preceding sheet has been grasped by the manipulator to be carried to the folding press, it being possible to load the new sheet even when the manipulator has returned to the original position to grasp a new plate sheet.

The unloading of the plate sheet after it has been worked on may be carried out immediately after the two jaws separate themselves up to the time when the manipulator is ready to move again to bring a new sheet towards the press.

With the device according to the present invention in addition it is possible to carry out both the loading and the unloading of the plate panels both from the right side as well as from the left side, it being possible for the loading to be carried out also in front. This is different from similar known devices in which the loading always must be carried out in a single direction.

All these features permit to cut down substantially the time required between the loading of the plate sheet on the manipulator and the arrival of the plate sheet on the folding press. Due to the particular motion of the moveable parts of the manipulator which requires energy reduced about in half with respect to the known similar devices, it is possible to utilize for the motion a motor of about one-half power with respect to motors used in known devices, naturally under equal conditions of mass of the manipulator, a fact which permits to lower the cost of the manipulator and also lower the consumption of energy required for the utilization of the same.

These and other characteristics of the invention will be illustrated in detail hereinbelow with respect to a particular embodiment by reference to the accompanying drawings of which:

Figure 1:
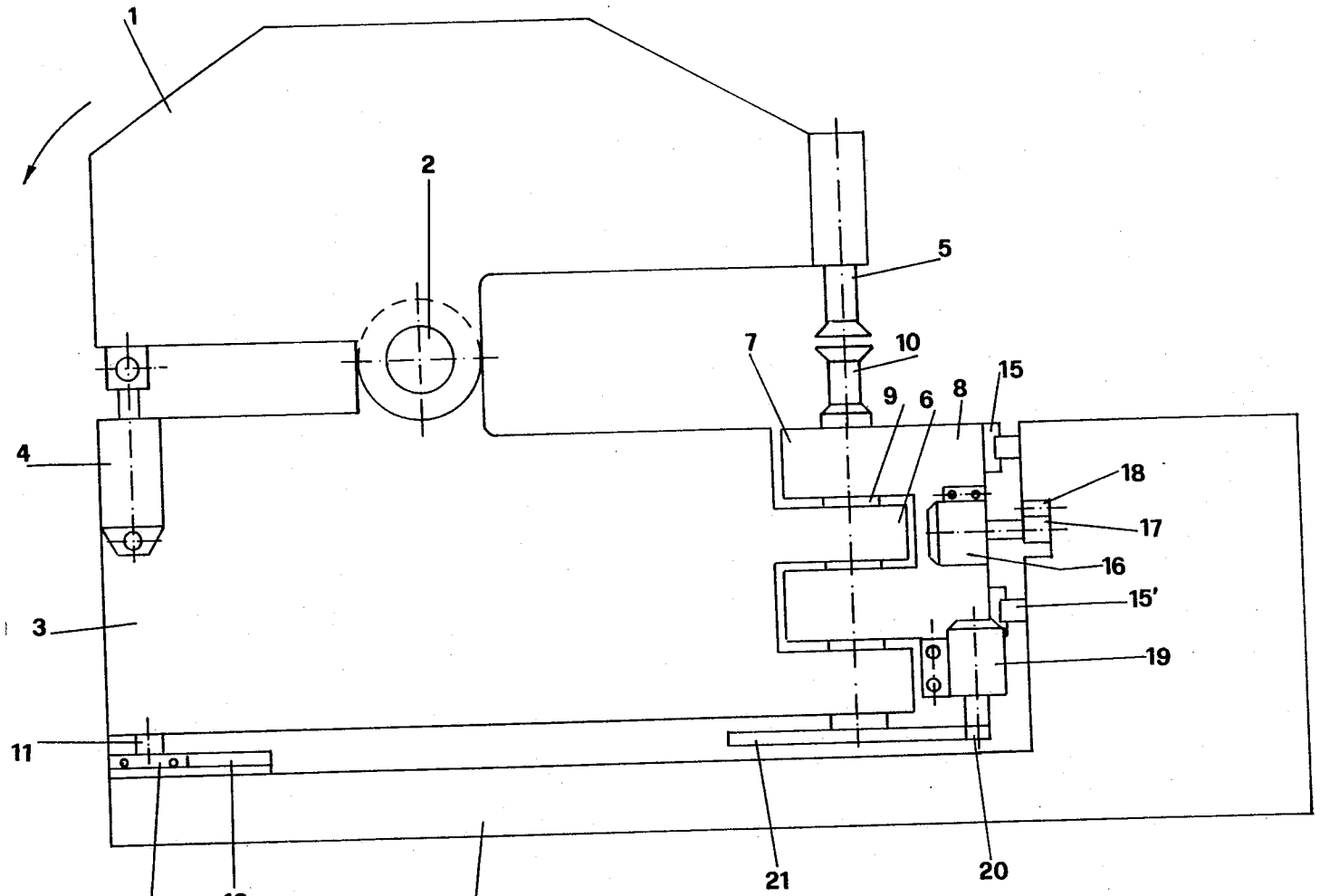
FIG. 1 is an overall front view of the apparatus according to the present invention.

FIG. 1 shows that the device according to the invention comprises an upper supporting element 1 pivoted at 2 to the lower support element 3. This structure assumes overall the shape of a double T. Corresponding to one of their wings, the two supporting elements are connected by means of fluid-dynamic cylinder 4, the body of which is fixed to one of the two elements and the stem is fixed to the opposite element. This body is capable of operating in a direction such as to determine the rotation of the upper supporting element 1 around pivot 2 so as to cause the two wings of the supporting elements connected by the fluid- dynamic cylinder to come closer and simultaneously causing the opposite wings to come further apart one from the other. Corresponding to the wing of the upper supporting element 1, opposite to the wing in which cylinder 4 is located, there is provided the upper jaw 5 which is vertically arranged and which is capable of rotating around its axis. The lateral extremity of the lower supporting element 3 has such a profile that it presents two or a plurality of teeth 6 inserted in the spaces provided between the corresponding teeth 7, the latter being formed in the longitudinal carriage 8. The lower supporting element 3 and the carriage 8 are reciprocally connected in a turnable manner by means of the shaft 9 which is vertically disposed and is fixed to the lower jaw 10, this shaft being located within seats formed on the teeth 6 and 7.

The lower supporting element 3 has a pin 11 which is pivoted on transversal carriage 12, the latter being moveable along guide 13. The entire structure is supported by a fixed base 14 which has a horizontal part, to which the head of the guide 13 is fixed. On the other hand, the head of the longitudinal carriage is connected to the vertical part of the base. The longitudinal carriage is connected to the same base by means of sliding blocks 15 which are horizontally disposed and which slide along linear guides 15', the latter being preferably of the type having a spherical re-circulation. The electric or hydraulic motor 16 is provided on the longitudinal carriage 8, the motor placing in rotation toothed wheel 17 which engages with rack 18 fixed to the vertical part of the fixed base and which extends in a longitudinal direction. Another electric motor 19 is present on the longitudinal carriage, the motor being disposed with a vertical axis, the motor being able to engage with the toothed wheel 21 by means of a pinion 20, the wheel being arranged also with a vertical axis fixed to the lower extremity of the shaft.

Figure 3:
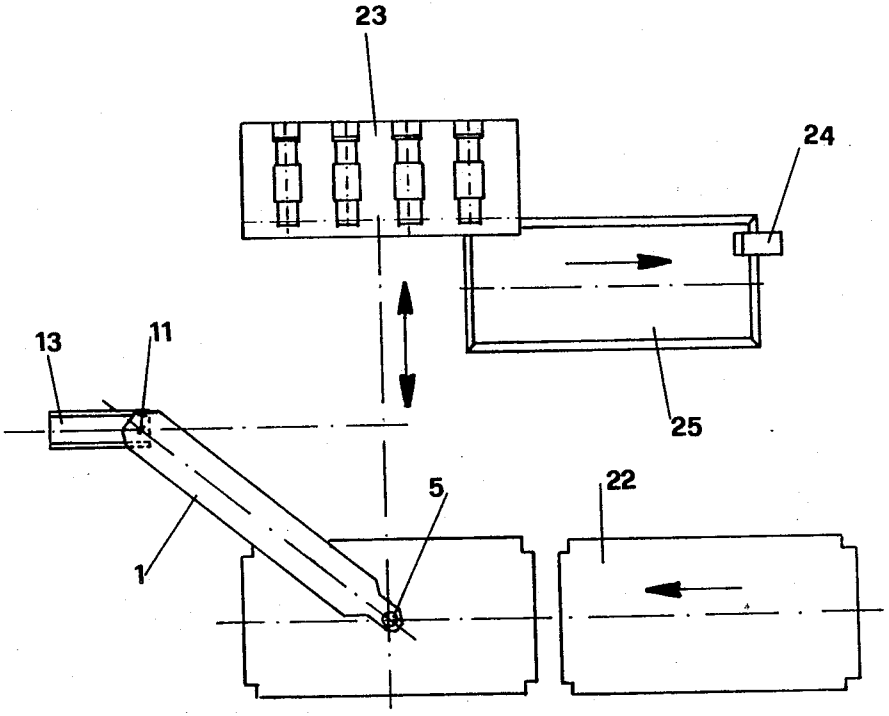
FIGS. 3, 4 and 5 illustrate schematically a top view of the device according to the present invention during three distinct phases of operation of the device.

With reference to FIG. 3, the plate sheet 22 which is loaded on the manipulator by means of suitable devices not shown because they are known in the art, is intended to be grasped by the grippers comprising the two jaws preferably corresponding to the central part of the same sheet. FIG. 3 shows that the loading occurs from the right side towards the left side in a transversal direction with respect to the direction of advance of the sheet from the loading zone to the press 23. In the loading position the transversal carriage and therefore the pin 11 are in a position corresponding to the end of the anterior course of the guide 13 as illustrated in the figure. The figure also shows that there is no problem inherent in the fact that the manipulator may be loaded from the left side or from the rear.

FIG. 3 also shows a plate 25 already subjected to the folding operation along its borders which is removed from the working zone, for instance by means of gripper 24.

Figure 4:
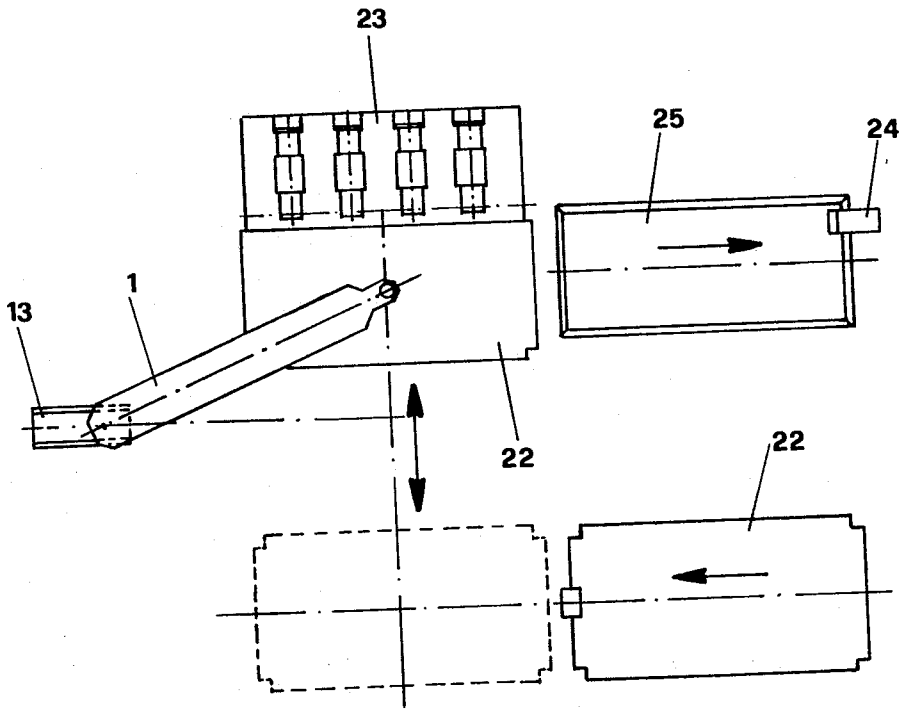
Figure 5:
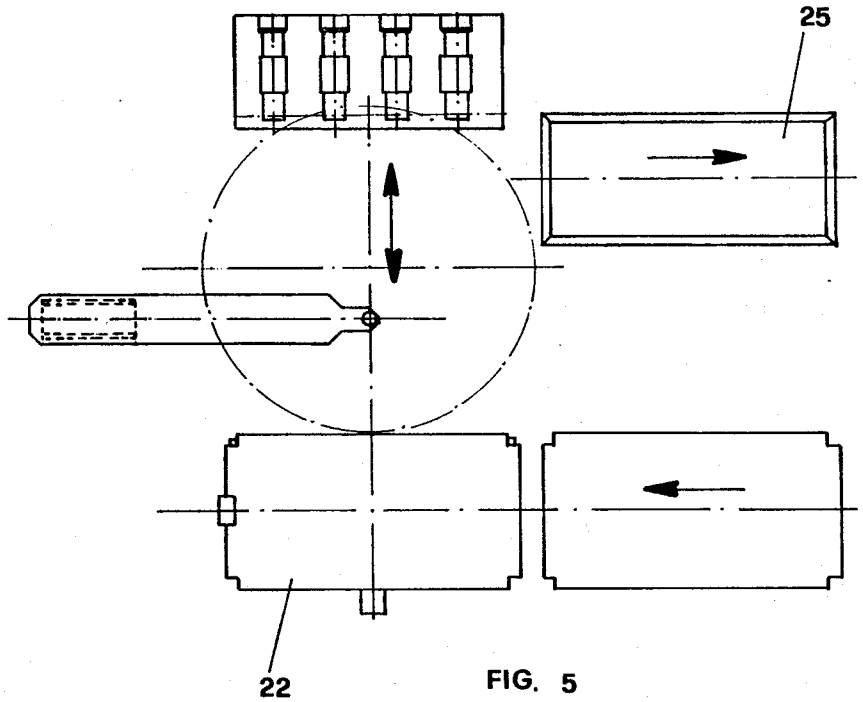

FIGS. 4 and 5 show that when the electric motor designated by numeral 16 in FIG. 1 begins its rotation, the longitudinal carriage is caused to move with respect to the fixed base, the longitudinal carriage and the fixed base not being shown in these figures for the sake of simplicity. Naturally, the transversal carriage is intended to slide on guide 13 and comes in a position corresponding to the terminal part of the same guide and corresponding to the center of the course as shown in FIG. 5, the course going from the loading zone to the press and returning again to the position corresponding to the most advanced part of the same guide as shown in FIG. 4. Naturally, while the carriage performs a rigorously rectilinear motion, the lower support element 3 performs a rototranslatory motion rotating on pin 11 which in turn moves rectilinearly on guide 13.

At the end of the course of the longitudinal carriage, the plate 22 is in a position such that one of its borders may be folded by press 23. If it is necessary to carry out the folding of the other borders of the plate, it is clear that the supporting elements 1 and 3 must be pushed back, also in this case following the rotation of the electric motor which determines the motions of the longitudinal carriage for the purpose of permitting the rotation of the plate, the rotation being determined by the motion of the electric motor 19 through the action of the toothed wheel 21, shaft 9 and therefore the lower jaw 10.

FIG. 5 shows in lines with dots and dashes the limit of the area of the plate during this rotation, the posterior limit of this circumference determining in practice the more advanced position corresponding to which the last plate 22 which must be loaded may be placed during the folding phase of the preceding plate. It is possible to locate the upper jaw 5 in such a manner that it is mounted idle within the seat formed in the upper support 1, the rotation of the jaw being guaranteed by the torsional force exerted on it through the plate by the lower jaw Alternatively, the upper jaw may be connected by means of mechanical return devices located within the bodies of the carriage 8 and the supporting elements 1 and 3 to the lower jaw 10. This solution is more complex from a constructive point of view than the solution described hereinabove but presents a great advantage because the two jaws perform always the same angular motions.

In fact, from a constructive point of view, it is almost impossible to ensure that the axes of the two jaws are perfectly superimposed. If the two axes are always in the same position, the dimensions of the folding will always be constant for each panel but if the axes are located in a more casual manner, each panel will present final dimensions different from the preceding one.

FIGS. 4 and 5 show that the unloading of plate 25 which has already been folded along its borders is carried out by a device well known in the art which utilizes, for instance, grippers 24 and the unloading may be carried out immediately after the two jaws open up and up to the time the manipulator, after having been loaded with another plate, reaches again the location in the proximity of the press. In fact, for the purpose of stability, this operation is delayed only up to the act of departure of the manipulator from the loading zone.

Figure 2:
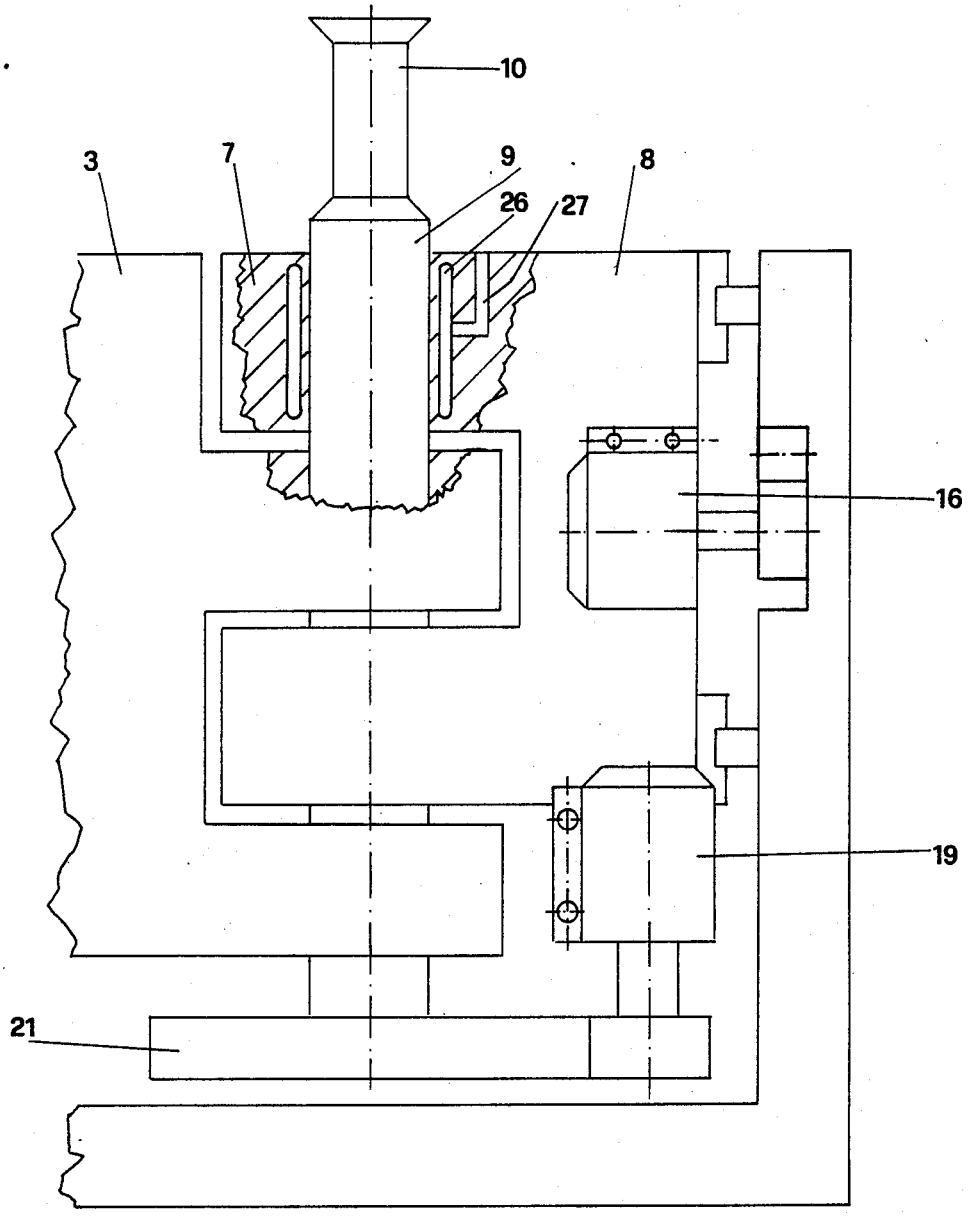
FIG. 2 is a view partially in cross-section of a portion of the device of the invention.

According to a preferred embodiment of the invention, a particular blocking mechanism is provided for the angular position of the jaw 10. As shown in FIG. 2, around the lateral surface of shaft 9, fixed to the lateral surface on one of the teeth 7 of the longitudinal carriage 8, there is formed a cylindrical annular chamber 26, which by means of conduit 27 may be filled with an hydraulic fluid inserted for instance by means of an hydraulic pump or similar device. The internal surface which limits chamber 26 and which constitutes the element of separation between the same and the external surface of shaft 9 is very small and therefore it is intended to be deformed elastically in an appreciable manner when the pressure of the fluid is greater than a certain pre-established value, thus interfering with the surface of the shaft and preventing its further rotation so that blocking is achieved. This type of blocking presents the great advantage of being extremely precise in any angular position of the shaft and therefore it is suitable in a particular manner to permit the folding of the plate corresponding to each angular position. This permits in particular to operate with a plate sheet of shape different from the rectangular shape. Further, it should be noted that occasionally the plates are not trimmed in a manner perfectly regular and may have a shape different from a perfectly rectangular shape. In the case in which the two plates must be superimposed, it is necessary that the borders perfectly correspond. By using the device mentioned hereinabove, it is possible to achieve a folding of the plate in such a manner that the folding does not result perfectly parallel to the border of the extremity of the sheet, thus permitting to offset the imperfection of the trimming and in particular to utilize a plate which might otherwise have been rejected.

What is claimed is:

1. In a manipulator for plate sheets which comprises a supporting structure with two jaws (5, 10) vertically disposed and axially aligned capable of grasping a plate sheet (22) horizontally disposed corresponding to the loading zone, said structure having means for actuating said manipulator, said means permitting the linear displacement of said sheet up to a folding press (23), means acting on said jaws capable of determining the rotation around their axis for the purpose of permitting said sheet to be subjected to a folding operation in at least one of its borders, the improvement which comprises said supporting structure having the shape of a double T with one upper element (1) being provided in the portion corresponding to the extremity of one of its wings with the seat for the shaft of the upper jaw (5), and a lower supporting element (3) pivoted to said upper element at the pivot point (2) corresponding to the central zone, said lower supporting element (3) having pin (11) pivoted to a transversal carriage (12), said transversal carriage being slidable along guide (13), said guide (13) being disposed in the perpendicular direction with respect to the area of juncture between the loading zone of the plate and the press, said guide being located laterally with respect to said area of juncture, its direction intersecting same corresponding to its central line, said guide being fixed to a fixed base (14), said base laterally with respect to the zone wherein said jaws are located, having a vertical extension, the lateral extremity of said lower supporting element (3) being pivoted to a longitudinal carriage (8) by means of supporting shaft (9) of said lower jaw (10), said longitudinal carriage (8) having laterally blocks (15), said blocks (15) sliding along linear guides (15') located on the vertical portion of said base (14), said guides extending in a parallel direction with respect to the line joining the loading zone and the press, means (16, 17 and 18) for determining the advance of said longitudinal carriage (8) along said guides and means (19, 20 and 21) capable of determining the rotation of said shaft (9) and said lower jaw (10).

2. The manipulator according to claim 1 wherein said means capable of determining the advance of said longitudinal carriage (8) consists of a motor (16) fixed to said carriage, said motor being located with a horizontal axis, said motor placing in rotation a toothed wheel (17), said wheel engaging a rack (18) located on the vertical part of said base, said rack extending in a parallel direction with respect to the direction of said linear guides (15').

3. The manipulator according to claim 1 wherein said means capable of permitting the rotation of said shaft (9) consists of an electric motor (19) fixed to said carriage (8), said motor placing in rotation toothed wheel (21) by means of a pinion (20), said toothed wheel being fixed and coaxial with said shaft (9).

4. The manipulator according to claim 1 wherein said two supporting elements (1 and 3) are connected one to the other corresponding to their wings opposite with respect to the wings in which said jaws are located, by means of cylinder (4) of fluid-dynamic type, said cylinder being fixed to one of said elements, said cylinder having a stem fixed to the other of said elements, said stem being capable of determining the motion of rotation of said upper element (1) around the central pivot (2) of said two elements.

5. The manipulator according to claim 1 wherein the lateral extremities of said lower supporting element (3) and said longitudinal carriage (8) which face each other are shaped in a manner to present a series of teeth which enter within the cavities present between the teeth of said opposite element.

6. The manipulator according to claim 1 wherein around said shaft (9) fixed to said lower jaw (10) is located a cylindrical annular chamber (26), the surface of separation between said chamber and the external surface of said shaft being made of elastic material and with limited thickness, the devise comprising means capable of determining the insertion in said chamber of fluid under pressure by means of conduit (27) formed in the body of said carriage 8.

7. The manipulator according to claim 1 wherein mechanical elements of return are provided, said elements being seated within the bodies of said longitudinal carriage (8) and said two supporting elements (1 and 3), said mechanical elements being capable of connecting the two jaws (5 and 10), said means permitting identical angular movements around the axis of said two jaws.

* * * * *